US008696375B2

(12) United States Patent
Yu et al.

(10) Patent No.: US 8,696,375 B2
(45) Date of Patent: Apr. 15, 2014

(54) CONNECTOR ASSEMBLY FOR TRANSMITTING DATA BETWEEN ELECTRONIC DEVICES

(75) Inventors: Hui Yu, Wuhan (CN); Li-Fu Xu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 7 days.

(21) Appl. No.: 13/469,095

(22) Filed: May 11, 2012

(65) Prior Publication Data

US 2013/0078868 A1 Mar. 28, 2013

(51) Int. Cl.
*H01R 13/625* (2006.01)

(52) U.S. Cl.
USPC ..... 439/345

(58) Field of Classification Search
USPC ..... 439/345, 660, 74
See application file for complete search history.

(56) References Cited

U.S. PATENT DOCUMENTS 5,199,884 A * 4/1993 Kaufman et al. ..... 439/74
6,805,571 B2 * 10/2004 Huang ..... 439/330

* cited by examiner

*Primary Examiner* — Ross Gushi
(74) *Attorney, Agent, or Firm* — Novak Druce Connolly Bove + Quigg LLP

(57) ABSTRACT

A connector assembly includes a first connector and a second connector. The first connector includes a concave slot and a protruding portion adjacent to the concave slot. The second connector includes a resisting member and a receiving slot adjacent to the resisting member. The resisting member is engaged in the concave slot, for preventing the first connector from moving relative to the second connector in a first direction; and the protruding portion is engaged in the receiving slot, for preventing the first connector from moving relative to the second connector in a second direction opposite to the first direction.

13 Claims, 4 Drawing Sheets

CONNECTOR ASSEMBLY FOR TRANSMITTING DATA BETWEEN ELECTRONIC DEVICES

BACKGROUND

1. Technical Field

The present disclosure relates to a connector assembly for transmitting data between two electronic devices.

2. Description of Related Art

A connector assembly is used for transmitting data between two electronic devices. The connector assembly includes a first connector assembly with a plurality of inserting slots and a second connector assembly with a plurality of plugs. Each plug must be inserted into a corresponding inserting slot, before the connector assembly can work normally. However, the first connector is easily disengaged from the second connector. Therefore, an improved connector assembly for an electronic device may be desired.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
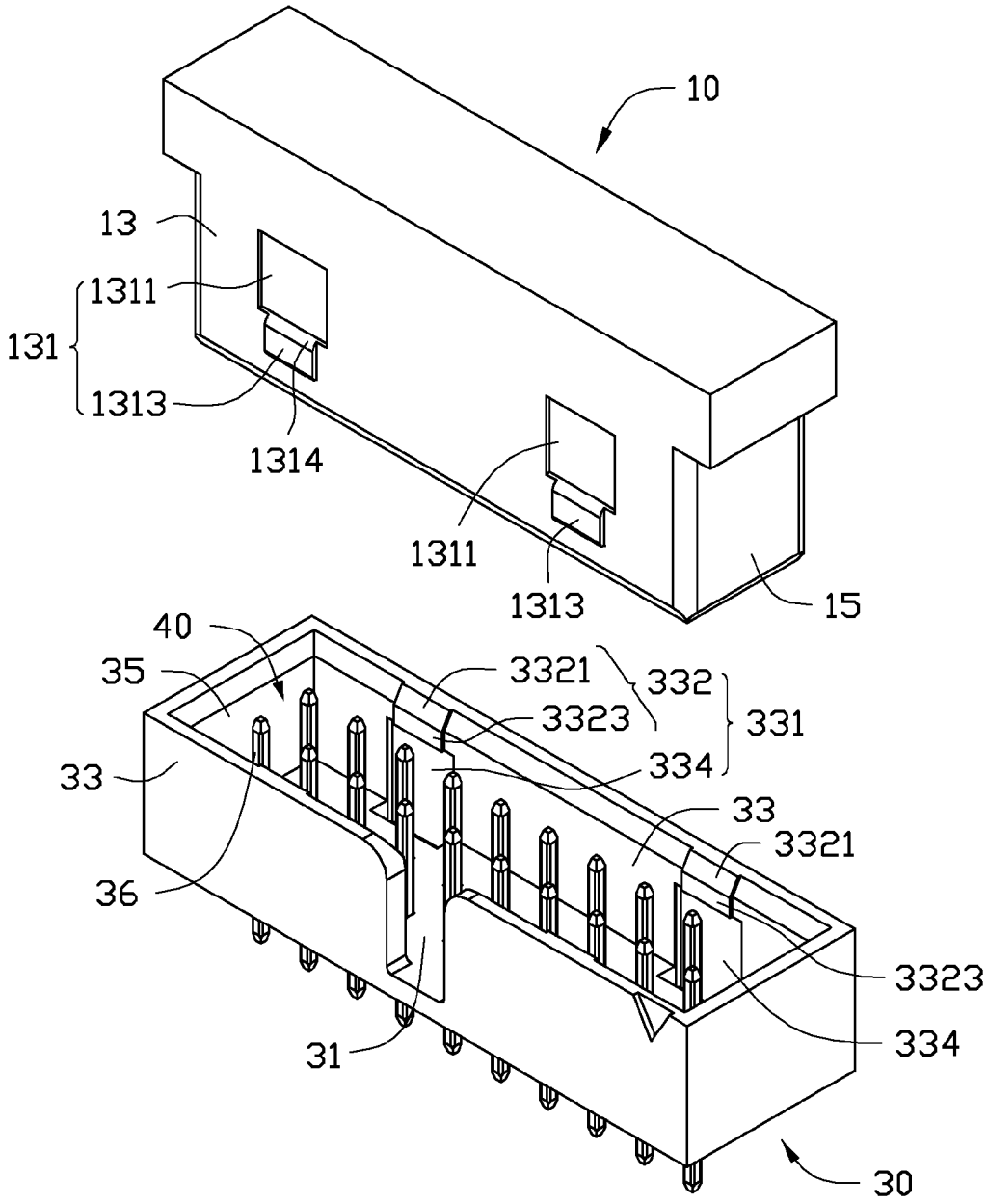
FIG. 1 is an exploded, isometric view of a connector assembly in accordance with an embodiment.
Figure 2:
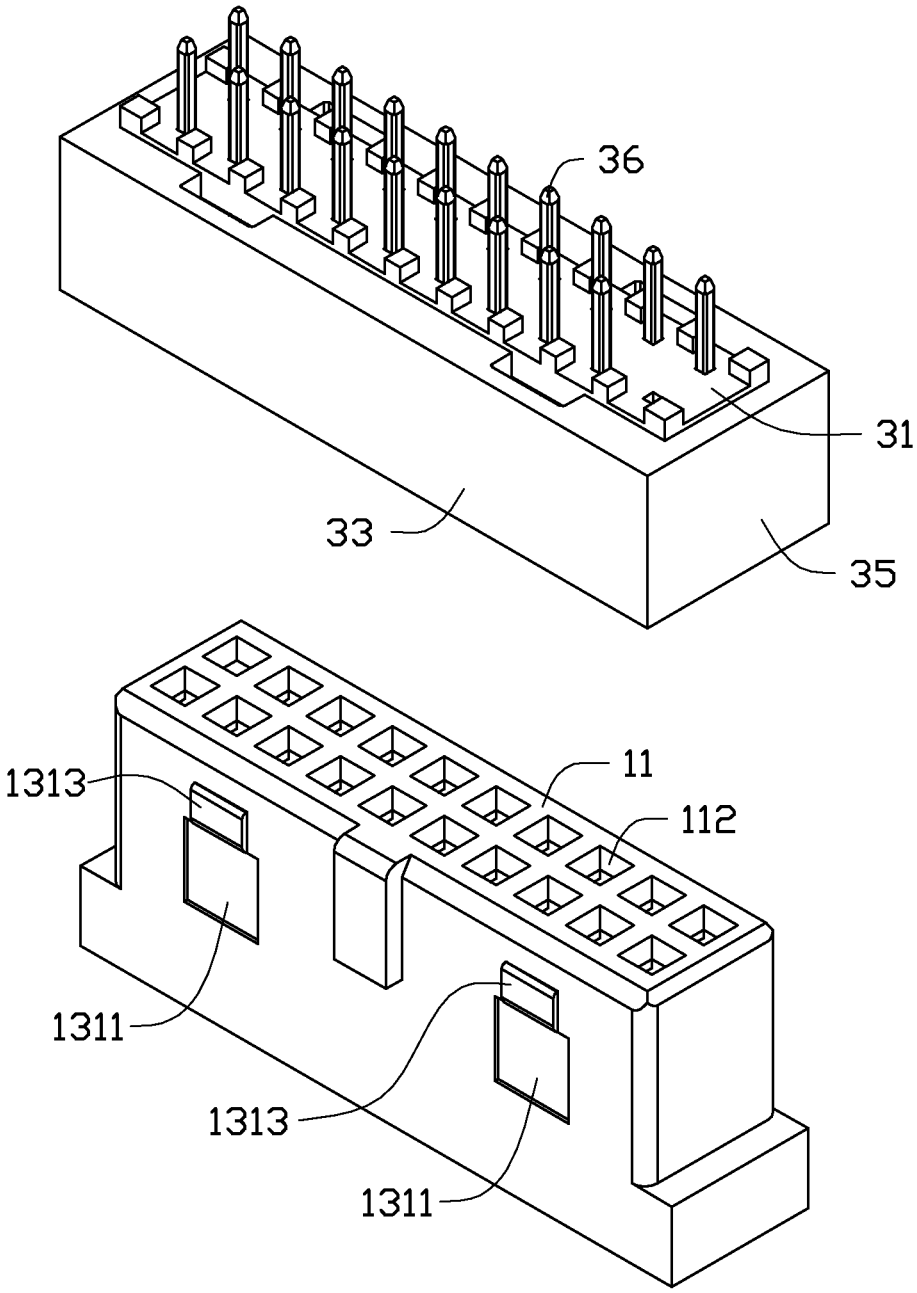
FIG. 2 is similar to FIG. 1, but viewed in a different aspect.

Referring to FIGS. 1 and 2, a connector assembly in accordance with an embodiment includes a first connector 10 and a second connector 30, engaged with the first connector 10. In one embodiment, a cross-section of the first connector 10 is T-shaped.

The first connector 10 includes a bottom plate 11, two first side plates 13, and two second side plates 15. The bottom plate 11 defines a plurality of inserting slots 112. Each of the plurality of inserting slots 112 is a rectangle. Two clipping devices 131 are located on each of the two first side plates 13. Each of the two clipping devices 131 includes a concave slot 1311 and a protruding portion 1313 adjacent to the concave slot 1311. In one embodiment, the concave slot 1311 is a rectangle, and a length of the concave slot 1311, along a direction substantially parallel to the bottom plate 11, is in a range between about 4.95 mm and about 5.05 mm. A connecting surface 1314 is connected to the concave slot 1311 and the protruding portion 1313. In one embodiment, the connecting surface 1314 is arcuate, and a thickness of the protruding portion 1313 is in a range between 0.35 mm and 2.95 mm.

The second connector 30 includes a base 31, two first side panels 33, and two second side panels 35. The base 31, the two first side panels 33, and the two second side panels 35 cooperatively defines a receiving space 40 for receiving the first connector 10. A plurality of plugs 36 are secured to the base 31 and extend through the base 31. Two engaging devices 331 are located on each of the two first side panels 33, and each of the two engaging devices 331 includes a resisting member 332 and a receiving slot 334, adjacent to the resisting member 332. The resisting member 332 includes a slanted portion 3321, and a resisting portion 3323 connected to the slanted portion 3321 and the receiving slot 334. In one embodiment, the resisting portion 3323 is substantially parallel to the first side panel 33.

Figure 3:
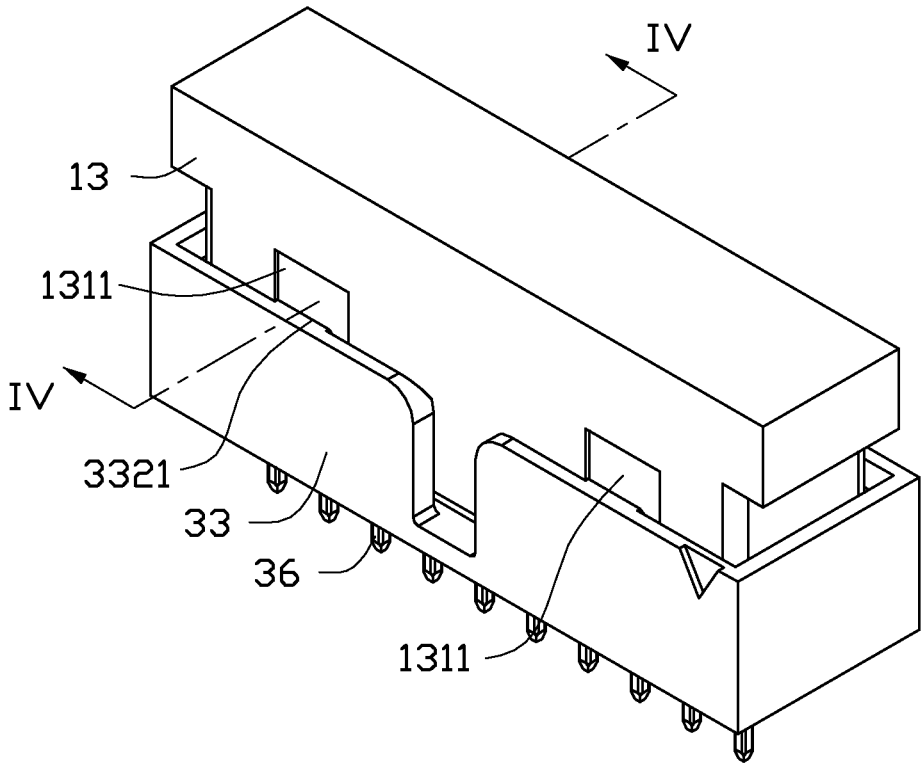
FIG. 3 is an assembled view of the connector assembly of FIG. 1.
Figure 4:
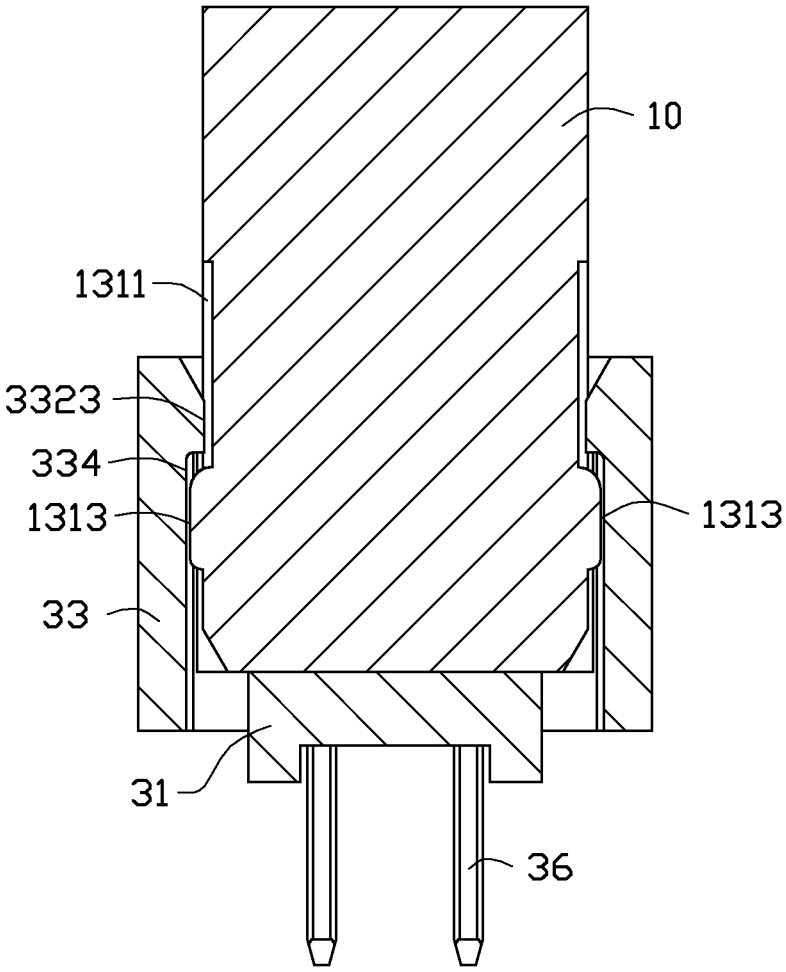
FIG. 4 is a cross-sectional view of FIG. 3, taken along a line IV-IV.

Referring to FIGS. 3-4, in assembly, the bottom plate 11 faces the plurality of plugs 36. The first connector 10 is moved towards the second connector 30, until each protruding portion 1313, of the two clipping devices 131, abuts each slanted portion 3321, of the two resisting members 332. The first connector 10 is further moved. The protruding portions 1313 extends through the slanted portion 3321 to engage in the receiving slots 334, for preventing the first connector 10 from disengaging from the second connector 30 in a first direction that is substantially perpendicular to the base 31. Each resisting portion 3323 of the two resisting member 332 is received in each concave slot 1311 of the two clipping device 131, for preventing the first connector 10 from disengaging from the second connector 30 in a second direction that is opposite to the first direction. The plurality of plugs 36 are engaged in the plurality of inserting slots 112, and the first connector 10 is thus secured to the second connector 30.

In use, the protruding portion 1313 is engaged in receiving slot 334, and the resisting portion 3323 is engaged in the concave slot 1311. Thus, the first connector 10 can be tightly engaged with the second connector 30.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A connector assembly comprising:

a first connector comprising a clipping device, the clipping device comprising a connecting surface, a protruding portion and a concave slot located above the protruding portion; the connecting surface connected to the connecting surface and the protruding portion; and the connecting surface being arcuate; and a second connector comprising an engaging device, the engaging device comprising a resisting member and a receiving slot that is located under the resisting member;

wherein the resisting member is engaged in the concave slot, for preventing the first connector from moving relative to the second connector in a first direction; and the protruding portion is engaged in the receiving slot, for preventing the first connector from moving relative to the second connector in a second direction opposite to the first direction.

2. The connector assembly of claim 1, wherein the second connector further comprises a first side panel, the resisting member comprises a slanted portion extending from a top edge of the first side panel, and the slanted portion is adapted to guide the protruding portion to slide into the receiving slot when the first connector is engaged with the second connector.

3. The connector assembly of claim 2, wherein the resisting member further comprises a resisting portion connected to the slanted portion and the receiving slot, and the resisting portion is substantially parallel to the first side panel.

4. The connector assembly of claim 1, wherein the concave slot is a rectangle.

5. The connector assembly of claim 1, wherein the first connector further comprises a bottom plate, and the first direction is substantially perpendicular to the bottom plate.

6. The connector assembly of claim 5, wherein the second connector further comprises a base, a plurality of plugs are located on the base, a plurality of inserting slots are defined in the bottom plate, and the plurality of plugs are received in the plurality of inserting slots.

7. The connector assembly of claim 1, wherein a cross-section of the first connector is T-shaped.

8. A connector assembly comprising:

a first connector comprising a bottom plate and a first side plate substantially perpendicular to the bottom plate, a concave slot, a protruding portion located on the first side plate, and a connecting surface connected to the concave slot and the protruding portion, and the connecting surface being arcuate; and the concave slot is located above the protruding portion; and a second connector comprising a first side panel, a resisting member and a receiving slot located on the first side panel, and the receiving slot is located under the resisting member;

wherein the resisting member is engaged in the concave slot, for preventing the first connector from moving relative to the second connector in a first direction that is substantially perpendicular to the bottom plate; and the protruding portion is engaged in the receiving slot, for preventing the first connector from moving relative to the second connector in a second direction opposite to the first direction.

9. The connector assembly of claim 8, wherein the resisting member comprises a slanted portion extending from a top edge of the first side panel, and the slanted portion is adapted to guide the protruding portion to slide into the receiving slot when the first connector is engaged with the second connector.

10. The connector assembly of claim 8, wherein the resisting member further comprises a resisting portion connected to the slanted portion and the receiving slot, and the resisting portion is substantially parallel to the first side panel.

11. The connector assembly of claim 8, wherein the concave slot is a rectangle.

12. The connector assembly of claim 8, wherein the second connector further comprises a base substantially perpendicular to the first side panel, a plurality of plugs are located on the base, a plurality of inserting slots are defined in the bottom plate, and the plurality of plugs are received in the plurality of inserting slots.

13. The connector assembly of claim 8, wherein a cross-section of the first connector is T-shaped.

* * * * *